US007344361B2

(12) United States Patent
Kiefer

(10) Patent No.: US 7,344,361 B2
(45) Date of Patent: Mar. 18, 2008

(54) VARIABLE-DELIVERY VANE PUMP

(75) Inventor: Clément Kiefer, Basse-Ham (FR)

(73) Assignee: Pierburg, Sarl, Yutz (FR)

( * ) Notice: Subject to any disclaimer, the term of this patent is extended or adjusted under 35 U.S.C. 154(b) by 680 days.

(21) Appl. No.: 10/489,452

(22) PCT Filed: Sep. 12, 2002

(86) PCT No.: PCT/EP02/10237

§ 371 (c)(1),
(2), (4) Date: Mar. 11, 2004

(87) PCT Pub. No.: WO03/023228

PCT Pub. Date: Mar. 20, 2003

(65) Prior Publication Data

US 2004/0247463 A1 Dec. 9, 2004

(30) Foreign Application Priority Data

Sep. 12, 2001 (FR) ..... 01 11825

(51) Int. Cl.
*F04B 49/00* (2006.01)
*F01C 20/18* (2006.01)

(52) U.S. Cl. ..... 417/220; 418/31

(58) Field of Classification Search ..... 417/220; 418/31, 24, 25, 26, 27
See application file for complete search history.

(56) References Cited

U.S. PATENT DOCUMENTS 3,238,884 A * 3/1966 Wright ..... 417/220
3,771,921 A * 11/1973 Rohde et al. ..... 417/12
4,780,069 A 10/1988 Dantlgraber et al.
2004/0136853 A1* 7/2004 Clements et al. ..... 418/24

* cited by examiner

*Primary Examiner*—Devon C. Kramer
*Assistant Examiner*—Jessica L Frantz
(74) *Attorney, Agent, or Firm*—Westerman, Hattori, Daniels & Adrian, LLP.

(57) ABSTRACT

A variable-capacity vane pump comprising a body (1) comprising a cavity (2) in which a mobile ring (3) can move, inside which a hub (4) is located which is rotatable around a fixed axis (R) and equipped with vanes (5) which during rotation are supported against an inner face of the mobile ring (3), displacing structure for moving the mobile ring (3) as a function of a control pressure between a position centered on the axis of rotation of the hub (4) and an extreme eccentric position with respect to the axis of rotation of the hub (4). According to the invention, the displacing structure of the mobile ring (3) comprise a recess (10) provided in the wall of the cavity (2) of the body (1), and a projection (9) formed on the outer face of the mobile ring (3) and designed to slide in the recess (10) of the cavity (2) of the body (1) so as to form a control chamber in which the control pressure is applied.

12 Claims, 3 Drawing Sheets

VARIABLE-DELIVERY VANE PUMP

Figure 1:
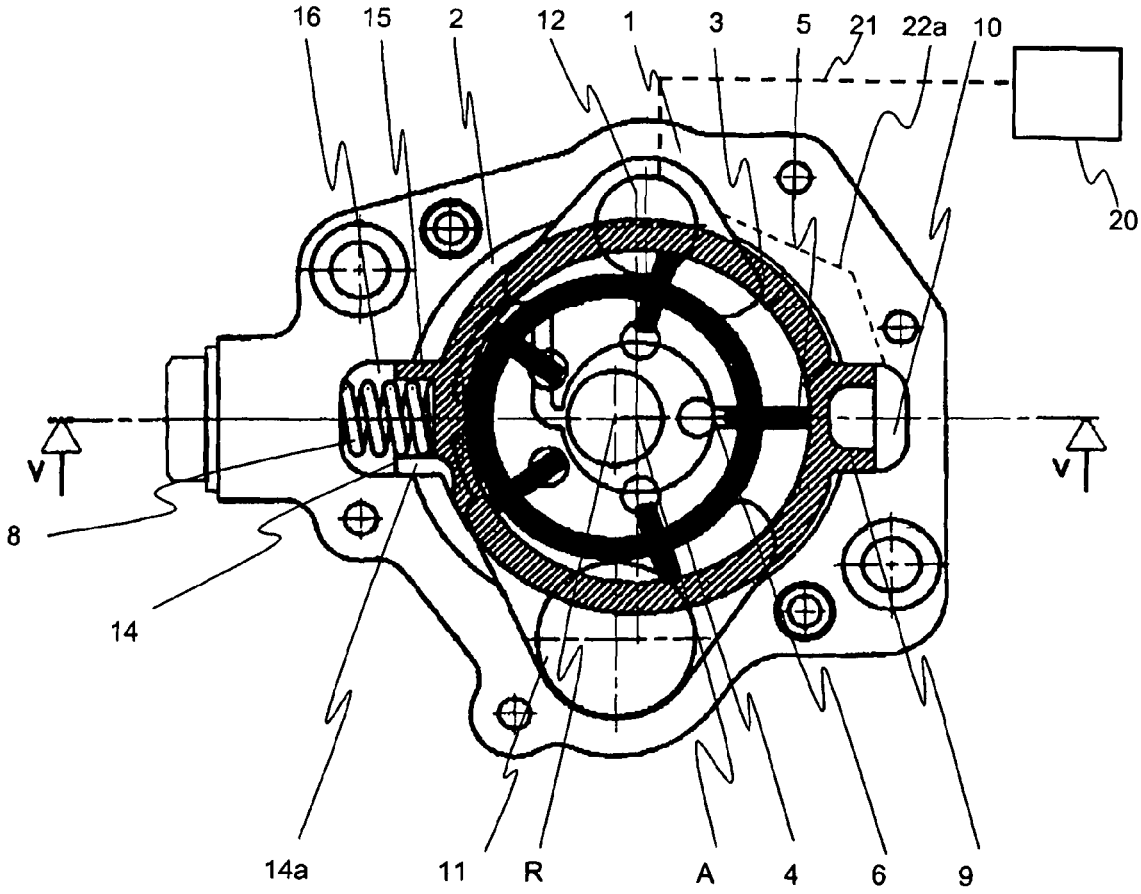

The present invention concerns a variable-capacity vane pump comprising a body having a cavity in which a mobile ring can move inside which a hub is located which is rotatable around a fixed axis and which is provided with vanes which during the rotation are supported against the inner face of the mobile ring, and displacing means for moving the mobile ring, as a function of a control pressure, between a position centered on the axis of rotation of the hub and a predefined extreme eccentric position with respect to the axis of rotation of the hub.

Vane pumps are conventionally used to move various fluids, in particular water, oil, or air for vacuum pumps. These pumps are made up essentially of a pump body closed by a cap, forming the stator, and a rotor equipped with radial slits in which vanes can slide. Two successive vanes, together with the inner face of the body and the outer face of the rotor as well as the bottom of the pump body and the cap, form a cell. Aspiration and delivery of fluid occur through the lower and upper faces formed by the bottom of the pump body and the cap. In the vicinity of the aspiration canal, cells are still small. During the rotation of the rotor, the cell grows and fills with fluid. When the cell has reached its maximal size, it is separated form the aspiration canal and comes into contact with the delivery canal. The volume of the cell starts to decrease until it reaches its minimal volume, thus delivering the fluid it contained.

The variation of flow rate or of the exit pressure can be obtained in different ways. In a first embodiment, the cavity that is provided in the pump body has a doubly eccentric inner section, the rotor rotating in the center of this section. With this embodiment, it is not possible to modify the volume so that at a given speed, the same pressure or the same flow rate are obtained.

A device is known from document U.S. Pat. No. 3,771,921 A that can be used either as a pump or as a generator. This device comprises a casing in which a mobile ring can take three positions: a central position, corresponding to a neutral point, and two eccentric positions with respect to the axis of the rotor, on both sides of the neutral point. Displacing means of the ring, constituted by, on the one hand, a spring, and on the other hand, a cavity in which an extremity of the mobile ring protrudes, make it possible to place the mobile ring in the desired position. The cavity is connected to the pressurized air conduit of an external pump. When the external pump is started, the ring is pushed into a first eccentric position by the pressurized air contained in the cavity against the force of the compression spring, and the pressurized air crosses the pump, which starts to rotate, thus acting as a generator. If the external pump is stopped, the mobile ring is moved by the spring toward the central position where it is blocked if a rod stops the backward movement of the ring, or toward a second eccentric position, symmetrical to the first with respect to the neutral point. The axis of the rotor is then coupled to the engine and the pump acts as a simple vane pump without the possibility of controlling its capacity. The movement of the ring thus makes it possible to modify the function of the device but without acting on its capacity.

Vane pumps exist which are designed in such a way that it is possible to adjust their capacity to enable adjusting the volume of the cells and thus adjusting the flow rate and the pressure.

These variable-capacity pumps operate according to the same principle, but a mobile ring is interposed between the cavity and the rotor. The mobile ring can move inside the cavity between a position where it is concentric with the axis of rotation of the rotor (neutral point) and an extreme eccentric position. The farther apart the axes, the larger the volume of the cells. The ring is maintained in an eccentric position by a return spring having adjustable tension. A piston is positioned opposite the spring and tends to push the ring back toward the neutral position. The piston is fed with the fluid coming out of the pump so that the more the pressure increases, the more the piston pushes the ring back toward a neutral position. When the pressure decreases, the return spring tends to push the ring back toward the eccentric position.

Such pumps are known for example from EP 0398 377 A.

These pumps make it possible to autoregulate the flow rate as a function of the pressure. However, the piston system constitutes a major drawback, because it requires a corresponding bore, which is costly.

Further, the movement of the mobile ring in the casing, either is not guided, or is guided by lateral surfaces located on the sides of the cavity, parallel to the plane of the movement of the mobile ring, on which corresponding surfaces of the ring slide. Further, the ring is sometimes thrown off balance because of the lateral pressure exerted on it in the delivery zone, which can lead to premature wear on the different parts and to dysfunctional operation of the system.

Finally, the aspiration and delivery zones are not isolated, so that it is not possible to reach a balance for the ring.

An objective of the invention is to develop a variable-capacity vane pump that does not require a specific piston or bore, and that, accordingly, is simpler to manufacture. A second objective of the invention is to enable a better guiding and a better balance of the ring. Finally, the invention also has as an objective to improve fluid tightness of the aspiration and delivery zones to ensure a better stability of the ring and to make it possible to reach the balance of the ring.

The first objective is attained by the vane pump in which the displacing means of the mobile ring comprise a recess provided in the wall of the cavity of the body, and a projection formed on the outer face of the ring and designed to slide in the recess of the body so as to form a control chamber in which the control pressure is applied. The recess and the projection replace the piston of the prior art. The more the pressure increases in the control chamber, the more the force applied on the projection tends to push the ring back toward the neutral position.

In a preferred embodiment of the invention, the control chamber formed by the recess and the projection communicates with the pressure zone of the pressure pump. Thus, the same pressure is applied in the pressure zone of the pump and in the control chamber.

It is also possible that the control pressure applied in the control chamber formed by the recess depends on the pressure existing in the utilization zone of the fluid pumped by the vane pump. This solution makes it possible to take into account the pressure drop between the delivery zone of the pump and the location of the engine where the pumped fluid is actually used.

In order to ensure the return of the ring to an eccentric position, it is provided that the displacing means further comprise a return spring that tends to move the mobile ring to its extreme eccentric position. This return spring is placed preferably on the other side with respect to the recess and the projection.

In order to improve the guiding of the mobile ring in the cavity of the body, it is provided that the pump is equipped with a control organ. The control organ ensures, together with the projection, a good guiding of the ring in the cavity of the pump body. The guiding organ is formed preferably by two walls placed on the outer surface of the mobile ring, on the other side with respect to the projection, parallel to each other, and parallel to the lateral sides of the projection, these walls being designed to slide in a corresponding recess provided in the wall of the body cavity. This simple embodiment allows for an inexpensive industrial application. It is thus possible to avoid the lateral guiding surfaces provided, on the one hand, in the walls of the cavity, and on the other hand, on the lateral sides of the ring.

In another preferred embodiment, means are provided for connecting the chamber formed by the guiding recess and the guiding organ with the aspiration zone or the pressure zone of the pump. In the latter case, it will be required to select the dimensions of the guiding organ such that the force applied to it by the pressurized fluid is lower than the force applied by the control pressure on the projection.

In order to ensure a better balance of the mobile ring in the cavity, it is preferable to select the dimensions of the casing and the mobile ring so that the component perpendicular to the movement of the ring of the resultant of the forces applied to the said mobile ring is the lowest possible, without necessarily being zero. The various forces that are applied to the ring are, on the one hand, the force of the fluid pressure inside the ring and the force of the fluid pressure on the outside of the ring, and on the other hand, the force of the control pressure in the control chamber and the force of the vanes on the ring as well as the force of the return spring. This balance of the ring will be obtained, for example, by offsetting the portion of the projection located on the side of the delivery zone and the corresponding portion of its recess, and/or the guiding wall located on the side of the delivery zone and the corresponding portion of the guiding recess, toward the delivery zone, so as to adjust the portion of the ring in contact with the delivery zone. The portion of the ring that is in contact with the delivery zone can be reduced as a function of the nominal pressure of the pump. Thus, for pumps with high nominal pressure, in which the pressure likely to exist in the delivery zone is very high, the portion of the mobile ring subjected to this pressure is smaller than for pumps with a lower nominal pressure. Thus, the mobile ring is better balanced and it is subjected to smaller forces.

In a variant embodiment of the invention, means are provided for isolating the aspiration zone and the delivery zone. By isolating the aspiration zone and the delivery zone, it is possible to reach the balance of the ring. This fluid tightness can be ensured in particular by the projection and the guiding organ. By leaving the component perpendicular to the movement of the ring of the resultant of the forces applied on the latter slightly above zero, a good fluid tightness is ensured by pushing the projection and one of the guiding walls in their respective recess on the side of the aspiration or delivery zone. Thus, the required play for good sliding of the projection and of the guiding walls in their respective recesses is not a cause of leakage. The sealing means can further include sealing washers placed between the top and bottom faces of the cavity of the body and the corresponding upper and lower faces of the hub.

Figure 2:
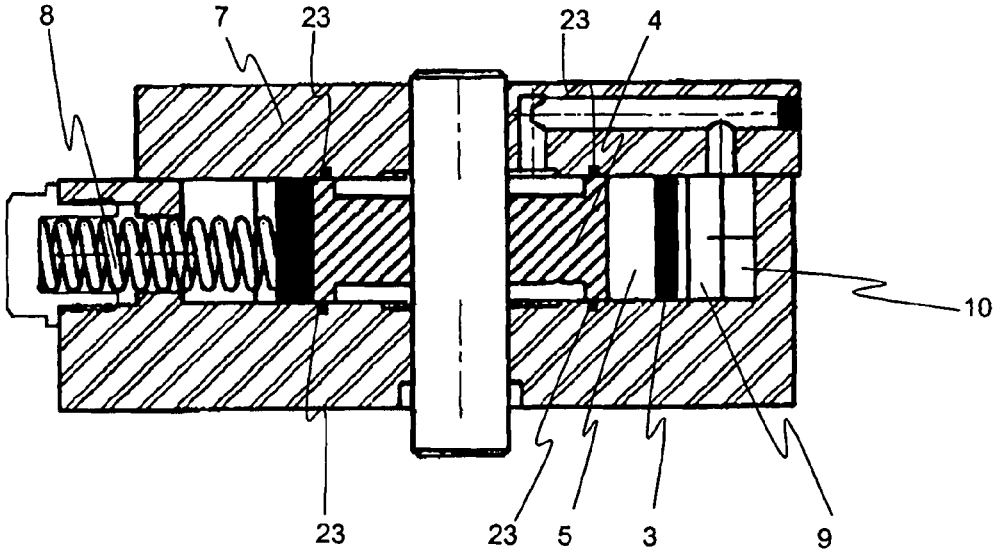
Figure 3:
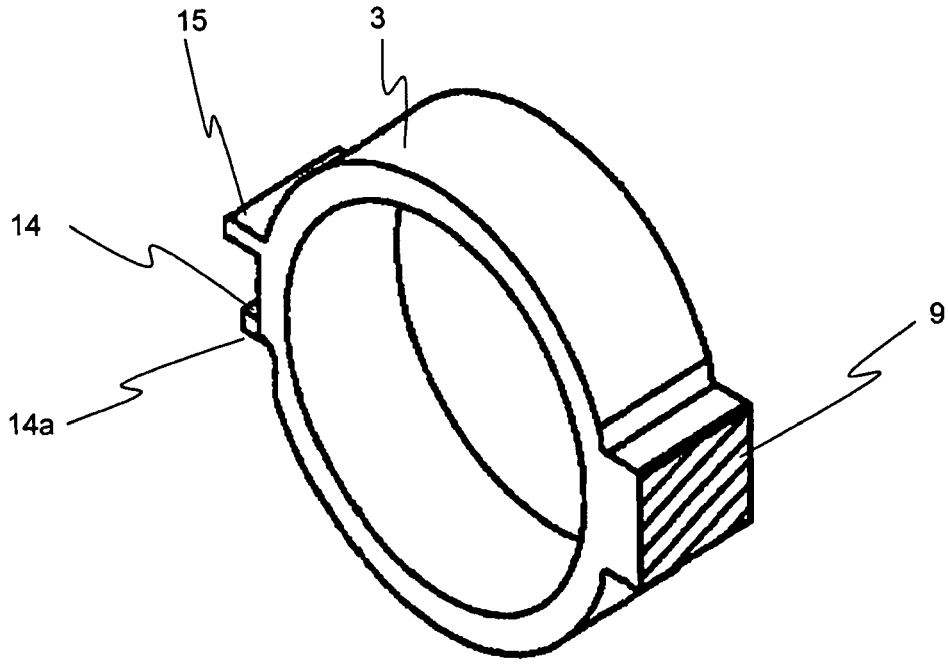
Figure 4:
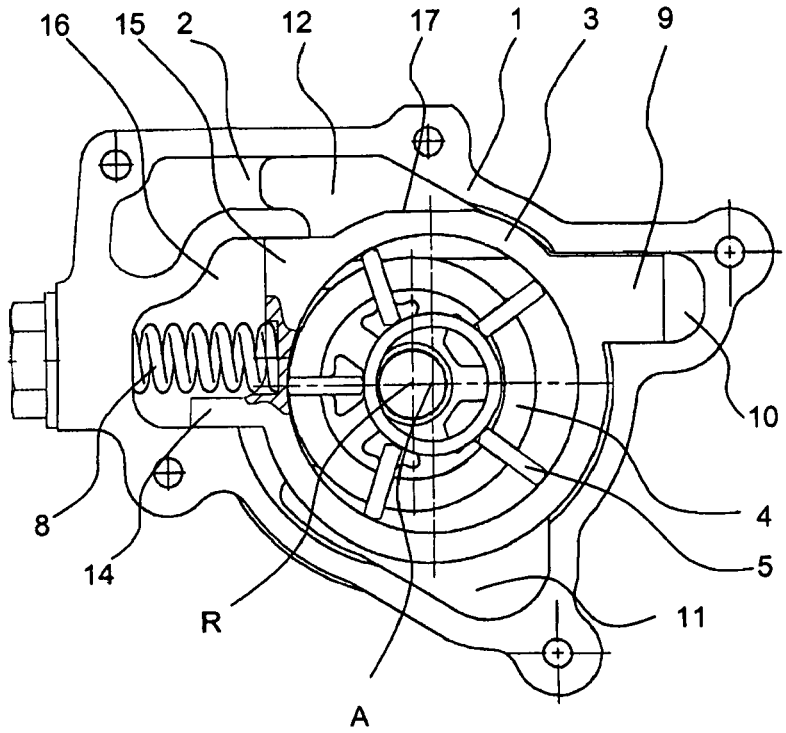

The invention will be described more in details below by reference to the following figures:

FIG. 1: cross-sectional top view of the body of a vane pump according to a first embodiment of the invention;

FIG. 2: cross-sectional view along line V-V of the vane pump of FIG. 1;

FIG. 3: perspective view of a mobile ring according to a first embodiment;

FIG. 4: top view of the body of a vane pump according to a second embodiment of the invention.

Figure 5:
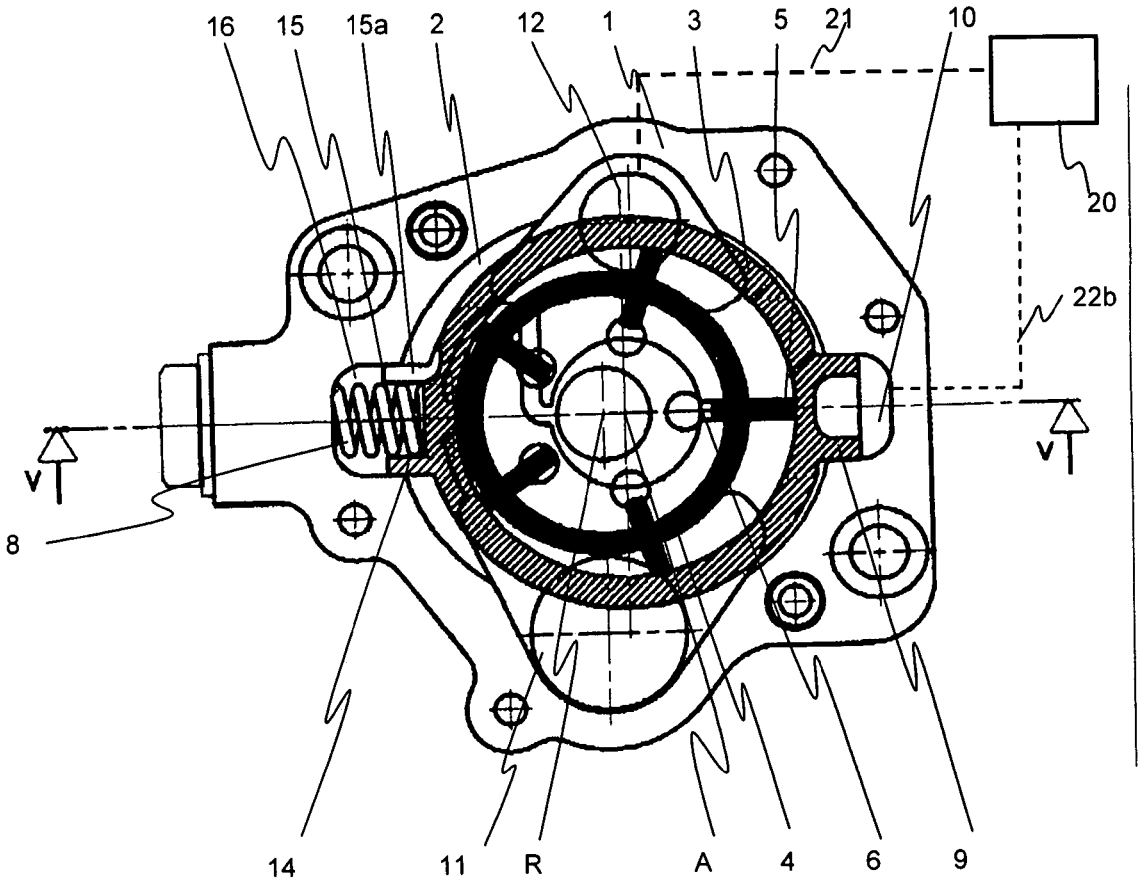

FIG. 5: cross-sectional top view of the body of a vane pump according to a third embodiment of the invention The two examples of embodiments presented below include the same elements which are accordingly numbered in the same way.

The vane pump is made up of a body (1) having a cavity (2) in which a mobile ring (3) can move. At the center of the cavity (2) and inside the mobile ring (3) is located a hub (4) equipped with vanes (5) which move in radial slits (6). A cap (7) closes the cavity (2).

The volume defined by the inner face of the mobile ring (3) is a cylinder having a circular basis in the examples presented in FIGS. 1 and 4. However, the base can also be elliptical, for example. This volume is characterized by its center (A). When the center of the ring (A) merges with the axis of rotation (R) of the hub (4), the pump is at the neutral point.

A return spring (8), whose tension can be adjusted by usual adjusting means, tends to move the ring (3) to an eccentric position with respect to the axis of rotation (R) of the hub (4). A projection (9) is formed on the circumference of the ring (3) on the other side with respect to the return spring (8). This projection (9) protrudes into a corresponding recess (10) provided in the wall of the cavity (2).

The aspiration canal (11) and the delivery canal (12) can be located, either in the bottom of the cavity (2) of the body (1), or in the cap. A utilization zone (20) can be in communication with the delivery zone (12). A supply canal (22*a*) connects the delivery zone (12) and the control chamber formed by the recess (10) and the projection (9) so that the same pressure exists in this chamber as in the delivery zone.

It is also possible to connect the control chamber, not with the delivery zone (12) of the pump, but with the zone (20) of the engine supplied by the pump in which the fluid pressure that must be controlled exists, as shown by (22*b*) on FIG. 5. Thus, pressure drops between the exit of the pump and the zone of the engine (or of any other device supplied by the pump) where the fluid must be present at a given pressure are taken into account.

The pressure applied by the fluid in the control chamber and the force of the spring act against each other and define the position of the ring (3) with respect to the axis of rotation of the hub (4) as a function of the pressure existing in the delivery zone (12) or of the utilization zone of the fluid. Thus, the center of the ring (A) moves along a plane parallel to the axis of rotation (R) of the hub (4).

Thus, the selected solution requires neither a bore nor a corresponding piston, which makes this embodiment much less expensive.

Further, a guiding organ is provided at the periphery of the ring (3) on the side of the return spring (8). This guiding organ is formed mainly of two walls (14, 15) placed on the outer face of the ring (3). These walls are parallel to each other and parallel to the lateral sides of the projection (9), and as a consequence, to the plane of movement of the center (A) of the mobile ring (3). These guiding walls (14, 15) protrude inside a corresponding guiding recess (16) provided in the cavity (2) of the body (1). The return spring (8) is supported on the ring (3) preferably between these two walls (14, 15).

These guiding walls (14, 15), in cooperation with the guiding recess (16) in which they can slide, and the control projection (9) in cooperation with the control recess (10), constitute guiding organs that ensure a good movement of the ring during use.

The adjustment of the dimensions of the projection (9) and the control recess (10), on the one hand, and of the guiding walls (14, 15) and the guiding recess (16), on the other hand, ensures a good fluid tightness between the aspiration zone and the delivery zone. In some cases, it can be necessary to complement this isolation by two sealing washers (23) placed, one between the upper face of the hub and the cap, and the other between the lower face of the hub and the bottom of the cavity (2) of the body (1), as shown on FIG. 2.

To ensure a balance of the pressures in the guiding chamber formed by the walls (14, 15), the periphery of the ring (3) and the recess (16), one of the walls (14, 15) has an opening in communication with the guiding chamber and either the aspiration zone, or the delivery zone. In the example of FIGS. 1 and 3, the wall (14) has an opening (14*a*) in communication with the aspiration zone (11), and in the example of FIG. 5, the wall (15) has an opening (15*a*) in communication with the delivery zone (12). It is also possible to provide a canal in the cap or in the bottom of the cavity, which is the solution selected in the example presented at FIG. 4.

It is possible to create a recess in the projection (9) formed on the circumference of the ring (3) to allow a saving in weight and material in the ring, as shown on FIG. 1.

In order to balance the mobile ring (3) and avoid subjecting it to excessive forces, it is preferable that the portion (17) of the outer surface of the mobile ring (3), which is subjected to the exit pressure existing in the delivery zone, is set as a function of the nominal power of the pump.

To this aim, it is possible, for example, as shown on FIG. 4, to offset more or less the portion of the projection (9) located on the side of the delivery zone and the corresponding portion of its recess (10) and/or the guiding wall (15) located on the side of the delivery zone and the corresponding portion of the guiding recess (16) toward the delivery zone. The support point of the spring (8) on the mobile ring (3) can also be offset toward the delivery zone. The offsetting toward the delivery zone of the projection (9)/recess (10), on the one hand, and/or of the guiding wall (15)/recess (16), is calculated so that the component perpendicular to the movement of the ring of the resultant of forces applied to it is as low as possible. It is possible to leave this component higher than zero, so as to maintain a good fluid tightness between the aspiration zone and the delivery zone. Thus balanced, the ring is subjected to less forces and it is less at risk of wearing out or deforming during use, which would create a risk of seeing leaks appear between the two aspiration and delivery zones, or of seeing the ring become stuck.

The vane pump according to the invention is simpler to manufacture than the pump according to the state of the art. Further, it does not require a piston. It is thus less expensive. Its guiding organs allow an easy movement of the ring. These sealing means make it possible to reach a balance of the ring. Thanks to the good balance of the mobile ring, the various elements wear out more slowly and the risk of dysfunctional operation is reduced.

LIST OF REFERENCE NUMERALS

1. pump body
2. cavity
3. ring
4. hub
5. vanes
6. radial slits
7. cap
8. return spring
9. projection
10. control recess
11. aspiration zone
12. delivery zone
14. guiding wall
15. guiding wall
16. guiding recess
17. portion of the outer surface of the mobile ring in contact with the delivery zone
A center of the ring
R axis of rotation of the hub

The invention claimed is:

1. Variable-capacity vane pump for pumping a medium from an aspiration zone to a delivery zone, said vane pump comprising a body comprising a cavity, in which a mobile ring can move, inside which a hub is located which is rotatable around a fixed axis and equipped with vanes which during rotation are supported against the inner face of the mobile ring, displacing means for moving the mobile ring as a function of a control pressure between a position centered on the axis of rotation of the hub and a predefined extreme eccentric position with respect to the axis of rotation of the hub, wherein the displacing means of the mobile ring comprise a control recess provided in the wall of the cavity of the body, and a projection formed on the outer face of the mobile ring and having lateral sides designed to slide inside the control recess of the cavity of the body so as to form a control chamber in which the control pressure is applied, and a guiding organ to guide the mobile ring in the cavity of the body, wherein the guiding organ is formed by walls placed on the outer surface of the mobile ring on another side of the mobile ring with respect to the projection, parallel to each other and parallel to the lateral sides of the projection, these walls being designed to slide in a corresponding guiding recess provided in the wall of the cavity of the body, wherein a first portion of the external surface of the ring between the projection and the guiding organ on a side of the aspiration zone is subjected to a pressure existing in the aspiration zone, and a second portion of the external surface of the ring between the projection and the guiding organ on a side of the delivery zone is subjected to a pressure existing in the delivery zone, and wherein a surface area of the second portion is smaller than a surface area of the first portion.

2. Vane pump according to claim 1, wherein the control chamber formed by the recess and the projection communicates with the delivery zone of the pump.

3. Vane pump according to claim 1, wherein the control pressure applied in the control chamber formed by the recess and the projection depends on a pressure existing in an utilization zone of the fluid downstream of the delivery zone.

4. Vane pump according to claim 1, wherein the displacing means further comprise a return spring tending to move the mobile ring to its extreme eccentric position, the said return spring being placed preferably on the other side with respect to the recess and the projection.

5. Vane pump according to claim 1, wherein means are provided for connecting the chamber formed by the guiding recess and the guiding organ with the aspiration zone or the delivery zone of the pump.

6. Vane pump according to claim 1, wherein means are provided to seal the aspiration zone and the delivery zone.

7. Vane pump according to claim 6, wherein the sealing means include the projection and the guiding organ.

8. Vane pump according to claim 6, wherein the sealing means comprise sealing washers placed between the upper and lower faces of the cavity of the body and the corresponding upper and lower faces of the hub.

9. Vane pump according to claim 1, wherein a recess is provided in the projection of the mobile ring, wherein this recess opens into the control chamber.

10. Vane pump according to claim 1, wherein a central sliding axis of the projection is located on the side of the delivery zone with respect to a plane comprising the axis of rotation of the hub and oriented along a sliding direction of the ring.

11. Vane pump according to claim 1, wherein a central sliding axis of the guiding organ is located on the side of the delivery zone with respect to a plane comprising the axis of rotation of the hub and oriented along a sliding direction of the ring.

12. Vane pump according to claim 1, wherein a central sliding axis of the projection and a central sliding axis of the guiding organ are located on the side of the delivery zone with respect to a plane comprising the axis of rotation of the hub and oriented along a sliding direction of the ring.

* * * * *